United States Patent [19]

Gagnon

[11] 4,146,812

[45] Mar. 27, 1979

[54] MOTOR VEHICLE HEADLIGHT HAVING FILLING HOLE SEALED WITH NON-RIGID MATERIAL

[75] Inventor: Peter R. Gagnon, Salem, Mass.

[73] Assignee: GTE Sylvania Incorporated, Danvers, Mass.

[21] Appl. No.: 901,399

[22] Filed: May 1, 1978

[51] Int. Cl.[2] ..... H01K 1/28; H01K 3/26

[52] U.S. Cl. ..... 313/113; 141/66; 313/184; 313/220; 316/24

[58] Field of Search ..... 313/113, 114, 115, 182, 313/220, 184; 316/20, 24; 141/65, 66; 362/347, 350

[56] References Cited

U.S. PATENT DOCUMENTS

| | | | |
|---|---|---|---|
| 3,364,378 | 1/1968 | Beesley | 313/113 X |
| 3,515,930 | 6/1970 | Walsh et al. | 313/113 X |
| 3,809,942 | 5/1974 | Boekkooi et al. | 313/113 |

*Primary Examiner*—Siegfried H. Grimm

*Attorney, Agent, or Firm*—James Theodosopoulos

[57] ABSTRACT

A motor vehicle headlight comprises a curved reflector having a lens bonded to the front thereof. A tungsten-halogen capsule is disposed within the reflector. A filling hole extends through the rear of the reflector, the hole being hermetically sealed by means of a nonrigid sealing material.

7 Claims, 3 Drawing Figures

MOTOR VEHICLE HEADLIGHT HAVING FILLING HOLE SEALED WITH NON-RIGID MATERIAL

THE INVENTION

This invention is concerned with motor vehicle headlights. It is particularly concerned with the filling and sealing of a sealed beam unit without the need of an exhaust tube, such as is shown in U.S. Pat. No. 3,898,451. Elimination of the exhaust tube reduces cost and eliminates a fragile part.

A tungsten-halogen capsule, such as that disclosed in U.S. Pat. No. 4,088,918, is placed in a curved reflector and a lens is then sealed to the front of the reflector. After the capsule is focussed and fixed in position, as disclosed in copending application Ser. No. 897,999, filed Apr. 20, 1978, entitled "Method Of Making Sealed Beam Lamp", same assignee, the disclosure of which is incorporated herein by reference, the envelope, which comprises the reflector and lens, is exhausted by means of a small hole through the back of the reflector and is filled to about atmospheric pressure with a dry gas. The hole is then sealed with a rubbery or nonrigid material.

DESCRIPTION OF THE PREFERRED EMBODIMENT

Figure 1:
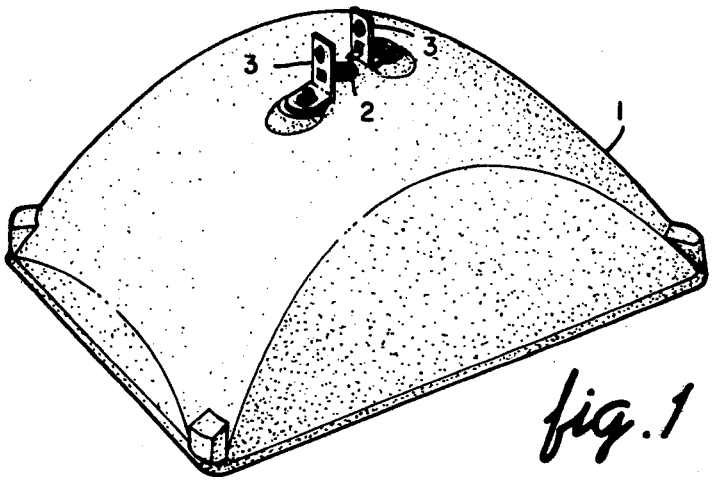
FIG. 1 shows the unsealed filling hole which extends through the back of the reflector of a headlight.
Figure 2:
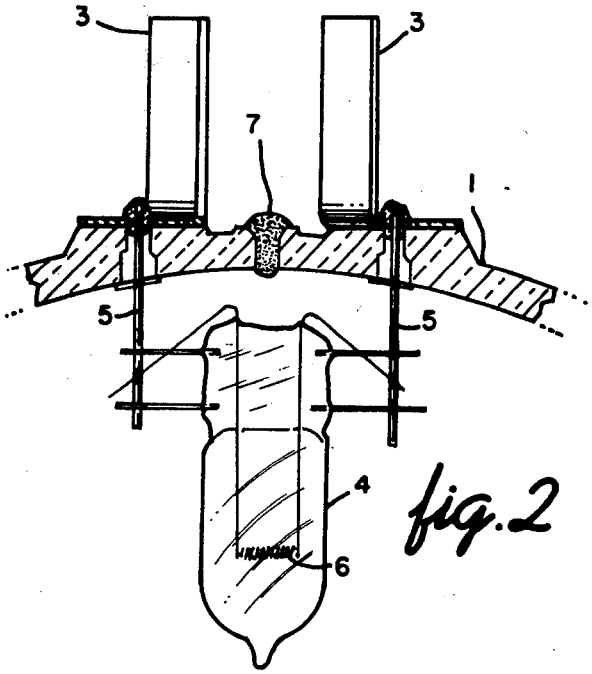
FIG. 2 is an expanded sectional view showing the tungsten-halogen capsule within the envelope and showing the hole sealed.

A headlight reflector envelope 1 has a filling hole 2 at the rear thereof. Hole 2 is generally disposed between electrical terminals 3. Disposed within envelope 1 is a tungsten-halogen capsule 4 which is supported on lead-in support wires 5. Lead-in support wires 5 are sealingly electrically connected to electrical terminals 3 and provide the path for electric current flow to filament 6 of capsule 4.

It is necessary to provide and maintain a dry atmosphere within envelope 1 in order to prevent corrosion by water vapor of the reflective film, usually aluminum, during the life of the lamp. Accordingly, envelope 1 is evacuated through hole 2 and is then filled with a dry gas to about atmospheric pressure. In one example, hole 2 was about 150 mils in diameter and envelope 1 was evacuated by means of a tube connected to a vacuum system. The end of the tube had a rubber ring around it which, when the tube was introduced to hole 2, engaged the surface of envelope 1 around hole 2 with sufficient contact pressure to provide a vacuum tight seal that permitted envelope 1 to be evacuated. After envelope 1 was evacuated to, say, about 100 microns, the vacuum was discontinued and dry nitrogen was introduced into envelope 1 through the same tube. After envelope 1 was filled to about atmospheric pressure, the tube was removed and hole 2 was sealed. It was not necessary to maintain a controlled atmosphere around envelope 1 prior to sealing of hole 2, because the pressure of the nitrogen within envelope 1 was atmospheric and, thus, there was substantially no diffusion of the ambient atmosphere into envelope 1 through hole 2 between the time the tube was removed and the time that hole 2 was sealed, which was only a matter of a few seconds.

Figure 3:
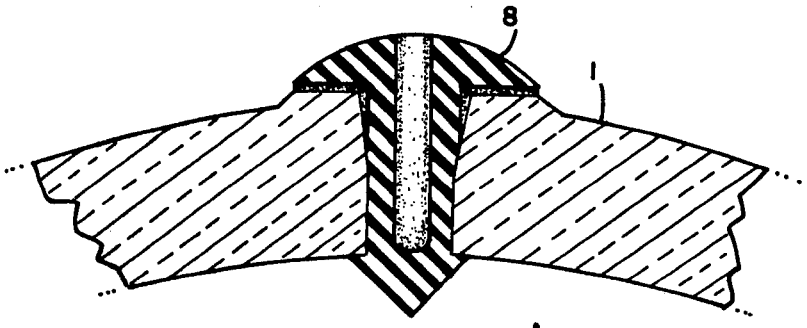
FIG. 3 shows another type of seal.

Hole 2 was then sealed by filling it with a paste-like, room-temperature-curing, silicone rubber 7. Filling material 7 had to be viscous enough so that it did not flow during the 24 hour curing cycle for the silicone rubber used. Hole 2 could also be sealed by use of a molded rubber plug 8 such as is shown in FIG. 3. Plug 8 is slightly oversize to insure a hermetic seal.

The material used to seal hole 2 should bond well enough and/or be of sufficient strength to withstand the following leak test. Sealed envelope 1 is completely immersed in water and a pressure of 2½ to 5 psig is applied to the surface of the water for 15 minutes. No water should leak into envelope 1 as a result of this test. In addition, the sealing material should be able to withstand a buildup of internal pressure inside envelope 1 of 2–3 psig without leaking; such a pressure could build up on a hot summer day. A rigid sealant is unsatisfactory since it can crack the glass envelope during thermal cycling.

I claim:

1. A motor vehicle headlight comprising: an envelope having a curved reflector at the rear thereof, and having a tungsten-halogen capsule disposed therein; a filling hole extending through the rear of the reflector, the filling hole being hermetically sealed by means of a nonrigid sealing material in the hole.

2. The headlight of claim 1 comprising, in addition, electrical terminals fastened to the rear of the reflector and wherein the filling hole is located between the terminals.

3. The headlight of claim 1 wherein the sealing material is a room-temperature-curing rubbery material that has been applied to the hole in a paste form.

4. The headlight of claim 1 wherein the sealing material is a plug of rubber-like material.

5. The method of making a motor vehicle headlight comprising the steps of: providing a reflector envelope containing a tungsten-halogen capsule and having a filling hole through the rear of the reflector; evacuating the envelope through the filling hole and filling the envelope with a dry gas to about atmospheric pressure; and sealing the filling hole with a nonrigid sealing material.

6. The method of claim 5 wherein the evacuating step is accomplished by means of a tube a part of which is rubber-like and is in sufficient pressure contact with the reflector about the hole to permit evacuation of the envelope.

7. The method of claim 5 wherein the filling hole is exposed to the ambient atmosphere for a short time between the evacuating step and the sealing step.

* * * * *